US007995944B2

(12) United States Patent
Lee

(10) Patent No.: US 7,995,944 B2
(45) Date of Patent: Aug. 9, 2011

(54) FUSING DEVICE AND IMAGE FORMING APPARATUS HAVING THE SAME

(75) Inventor: Jin-Sung Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 221 days.

(21) Appl. No.: 12/488,938

(22) Filed: Jun. 22, 2009

(65) Prior Publication Data

US 2010/0098467 A1 Apr. 22, 2010

(30) Foreign Application Priority Data

Oct. 16, 2008 (KR) ..... 10-2008-0101521

(51) Int. Cl.
*G03G 15/20* (2006.01)

(52) U.S. Cl. ..... 399/69

(58) Field of Classification Search ..... 399/69, 399/328, 329, 330, 331, 336; 219/216
See application file for complete search history.

(56) References Cited

U.S. PATENT DOCUMENTS

| | | | | |
|---|---|---|---|---|
| 4,737,818 | A * | 4/1988 | Tanaka et al. | 399/70 |
| 5,563,696 | A * | 10/1996 | Futagawa et al. | 399/69 |
| 2008/0181643 | A1 * | 7/2008 | Sato | 399/69 |

FOREIGN PATENT DOCUMENTS

| | | | |
|---|---|---|---|
| JP | 07295436 | A * | 11/1995 |
| JP | 2003302861 | A * | 10/2003 |
| JP | 2004258550 | A * | 9/2004 |
| JP | 2005173358 | A * | 6/2005 |
| JP | 2007-226024 | | 9/2007 |
| JP | 2007-256583 | | 10/2007 |

OTHER PUBLICATIONS

English abstract of JP-2007-226024.
English abstract of JP-2007-256583.
Machine English language translation of JP-2007-226024.
Machine English language translation of JP-2007-256583.

* cited by examiner

*Primary Examiner* — Robert Beatty
(74) *Attorney, Agent, or Firm* — Stanzione & Kim, LLP

(57) ABSTRACT

A fusing device includes a heating unit which provides heat for fixing toner on paper, a pressure unit which is aligned with the heating unit, and which provides pressure for fixing the toner onto the paper. The fusing device further includes a heat applying unit that heats the surface of the pressure unit so that the temperature difference between the surface of the pressure unit and the heating unit satisfies the regression equation $\Delta T \leqq -a*M+b$, where $\Delta T$ denotes the temperature difference, a and b denote empirically determined coefficients, and M denotes the molecular weight of the toner.

12 Claims, 7 Drawing Sheets

FUSING DEVICE AND IMAGE FORMING APPARATUS HAVING THE SAME

CROSS -REFERENCE TO RELATED APPLICATIONS

This application claims the benefit under 35 U.S.C. §119 (a) of Korean Patent Application No. 10-2008-0101521, filed Oct. 16, 2008, in the Korean Intellectual Property Office, the entire disclosures of which are hereby incorporated by reference.

TECHNICAL FIELD

The present disclosure relates generally to a fusing device and an image forming apparatus having the same, and more particularly, to a fusing device which externally heats the surface of a pressure unit, thereby increasing thermal efficiency, and an image forming apparatus having the same.

BACKGROUND OF RELATED ART

With the development of the electronics technology, diverse array of electronic devices have been developed, and have become widespread. Examples of such electronic devices include an image forming apparatuses, such as, for example, printers, scanners, facsimile machines, copiers, and multifunction peripherals, each of which forms images on paper or a recording medium.

Image forming processes utilized by these apparatuses are also diverse. Recently, the electrophotographic method has seen wide usage.

An electrophotographic image forming apparatus uses a fusing device. The fusing device provides heat and pressure using a heating roller and a pressure roller respectively in order to fix toner on paper. The adhesion of toner depends on the amount of heat supplied to the paper or to the toner, as well as the fusing temperature and pressure. That is, if the amount of heat supplied to the toner is insufficient, the toner particles may not be fully melted, and so-called a "cold-off effect," in which the toner particles become detached from the paper and contaminate other components, e.g., belts, rollers, etc., may occur. Also, as the printing speed is made faster, the time allotted for the transfer of heat to the toner may become shorter, exacerbating the adhesion problem.

As an attempts to enhance the fusing of the toner and to increase the printing speed, internally heating of the pressure roller has been suggested. However, the thick elastic layer formed on the surface of a pressure roller makes it difficult to transfer the internally applied heat up to the surface of the pressure roller, so the thermal efficiency is low.

SUMMARY OF THE DISCLOSURE

An aspect of the present disclosure aims to provide a fusing device that externally heats the surface of a pressure unit so as to be suitable for the desired specific fusing condition, thereby increasing the adhesion of toner and/or the critical printing speed, and to provide an image forming apparatus having such fusing device.

According to an aspect of the present disclosure, a fusing device may be provided to include a heating unit, a pressure unit and a heat applying unit. The heating unit may be configured to provide heat for fixing toner onto paper. The pressure unit may be arranged to face the heating unit so as to provide pressure on the paper placed between the heating unit and die pressure unit. The heat applying unit may be arranged adjacent the pressure unit to heat a surface of the pressure unit such that a temperature difference between the surface of the pressure unit and the heating unit satisfies the regression equation $\Delta T \leqq -a \times M + b$, where $\Delta T$ denotes the temperature difference, a and b denotes empirically determined coefficients, and where M denotes the molecular weight of the toner.

The pressure unit may comprise a pressure roller on which an elastic layer is formed.

The heat applying unit may comprise a roller which rotates in contact with the pressure roller and a heat source which is disposed inside the roller so as to heat the roller.

The roller may be formed of metal. The diameter of the roller may be approximately between 10% and 50% of that of the pressure roller. The thickness of the roller may be approximately between 0.6 mm and 1.5 mm. The width of a contact area between the pressure roller and the roller may be approximately between 2 mm and 10 mm.

The heat applying unit may alternatively comprise a heat source arranged adjacent a side of the pressure roller so as to heat the surface of the pressure roller.

The heat applying unit may alternatively comprise a heat source disposed adjacent a side of the pressure roller and a reflector which reflects and focuses heat generated by the heat source onto the surface of the pressure roller.

The heating unit may comprise a belt configured to turns with a portion of the outer surface of the belt unit in contact with the pressure unit and a heat source disposed inside the belt.

The values for a and b may be 0.243 and 117.3, respectively.

According to another aspect, an image forming apparatus may be provided to include a charging unit, an exposing unit, a developing unit, a transfer unit, a heating unit, a pressure unit and a heat applying unit. The charging unit may be arranged adjacent a photosensitive body, and may be configured to charge a surface of the photosensitive body. The exposing unit may include a light source, and may be configured to scan light, thereby forming a latent image, on the charged surface of the photosensitive body. The developing unit may be arranged adjacent the photosensitive body, and may be configured to provide toner to the surface of the photosensitive body to develop the latent image into a toner image. The transfer unit may have a transfer surface that is configured to contact paper so as to transfer the toner image onto the paper. The heating unit may be arranged to come into contact with the paper bearing the toner image, and may be configured supply heat to the paper so as to fix the toner image onto the paper. The pressure unit may form a nip with the heating unit, and may be configured to supply pressure to the paper so as to fix the toner image onto the paper. The heat applying unit may be arranged adjacent, and applying heat to, a surface of the pressure unit such that the temperature difference between the nip and the surface of the pressure unit satisfies the regression equation $\Delta T \leqq -a \times M + b$, where $\Delta T$ denotes the temperature difference, a and b denote empirically determined coefficient, and where M denotes the molecular weight of the toner.

BRIEF DESCRIPTION OF THE DRAWINGS

Various aspects and advantages of the disclosure will become apparent and more readily appreciated from the following description of the embodiments, taken in conjunction with the accompanying drawings, in which.

DETAILED DESCRIPTION OF SEVERAL EMBODIMENTS

Figure 1:
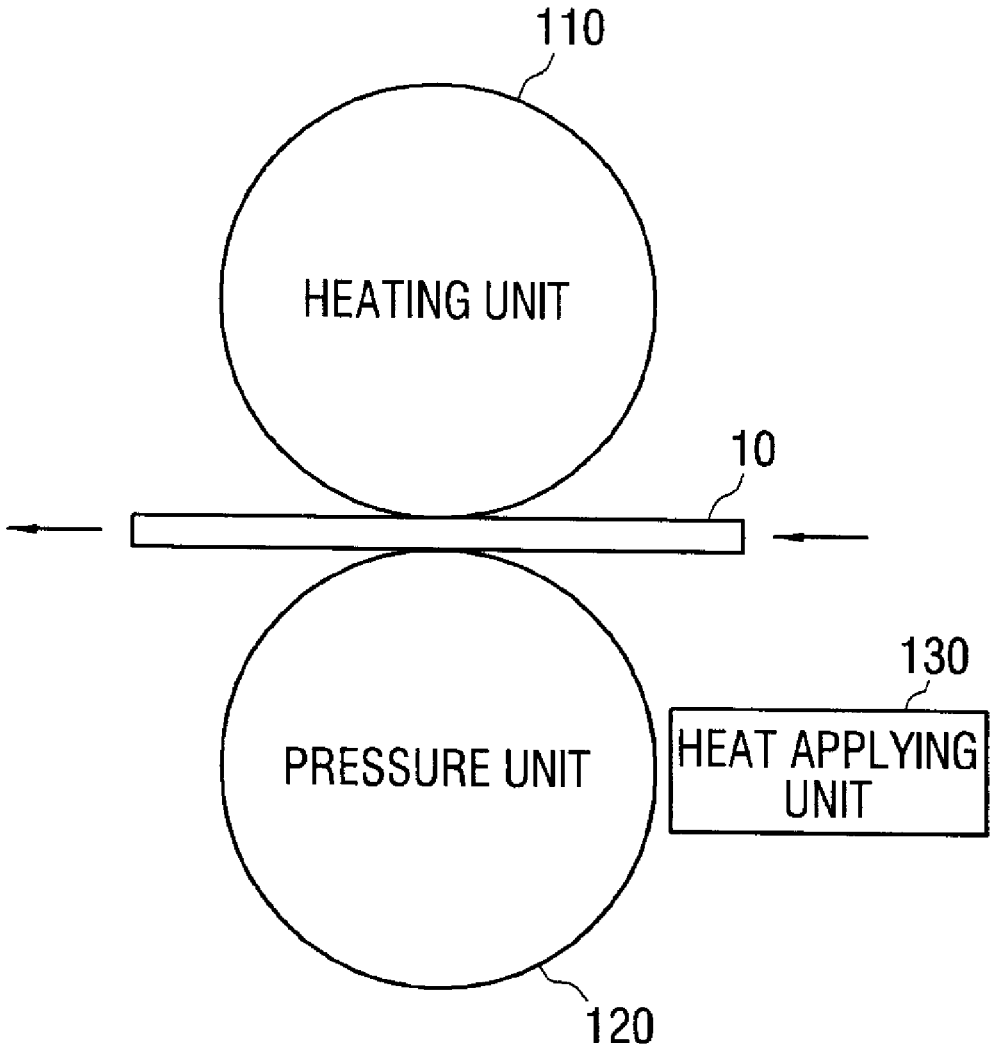
FIG. 1 illustrates a configuration of a fusing device according to an embodiment of the present disclosure.

Several embodiments of the present invention will now be described in greater detail with reference to the accompanying drawings. In the following description, same drawing reference numerals are used for the same elements even in different, drawings. The matters defined in the description, such as detailed construction and elements, are provided to assist in a comprehensive understanding of the embodiments. Thus, it should be apparent that the embodiments described herein can be carried out without those specifically defined matters. Also, well-known functions or constructions are not described in detail in order not to obscure the disclosure with unnecessary detail. Also, descriptions of well-known functions and constructions are omitted for clarity and conciseness.

FIG. 1 illustrates a configuration of a fusing device according to an embodiment of the present disclosure. Referring to FIG. 1, the fusing device may include a heating unit 110, a pressure unit 120 and a heat applying unit 130. In addition to the fusing device shown in FIG. 1, an image forming apparatus according to an embodiment may further comprise other components, such as, for example, a photosensitive unit, a charging unit, an exposing unit, a developing unit, and a transfer unit. By way of a brief description of an image forming process may generally involve the charging of the surface of the photosensitive unit with a charging unit, forming a latent image on the charged surface by exposing with light using an exposing unit, developing the latent image into a toner image by supplying the toner from a developing unit to the latent image and transferring the toner image onto paper using a transfer unit. Finally, the transferred toner image is fixed on the paper by the fusing device, after which the paper bearing the fixed toner image delivered out of the image forming apparatus.

Referring to FIG. 1, as the paper 10 bearing the toner image passes between them, the heating unit 110 and the pressure unit 120 apply heat and pressure to on the paper surfaces so as to fix the toner onto the paper 10. That is, the heating unit 110 provides heat for fixing, and the pressure unit 120 provides pressure for fixing. While the he heating unit 110 is shown as a roller device, it may alternatively be implemented as a belt.

The pressure unit 120 may be implemented as a pressure roller or belt, and may include an elastic layer of a certain thickness formed on the surface thereof so that sufficient contact area or a nip with the heating unit 110 can be ensured.

The heat applying unit 130 may be disposed adjacent the pressure unit 120 so as to heat the surface of the pressure unit 120, and may thereby improve the adhesion or fusing of the toner to the paper and/or to allow an increase in the critical printing speed.

The heating of the pressure unit 120 however may not necessarily lead to an increase of adhesion of the toner or the critical printing speed under all conditions. According to an aspect of the present disclosure, the specific conditions under which an improvement can be realized may be vary adaptively according, e.g., to the molecular weight of the toner. For example, the heat applying unit 130 may heat the pressure unit 120 so as to satisfy the relationship defined in a regression equation $\Delta T \leqq -a*M+b$, where $\Delta T$ is the temperature difference between the surface of the pressure unit 120 and the heating unit 110. In the foregoing regression equation, a and b denote actual numbers whose values may be set empirically. M denotes the molecular weight of the toner. M can be expressed using diverse units, and may be expressed, for example, as (the actual molecular weight of toner)$\times 10^3$. The process of setting the regression equation and the values of a and b will be described greater detail later.

Figure 2:
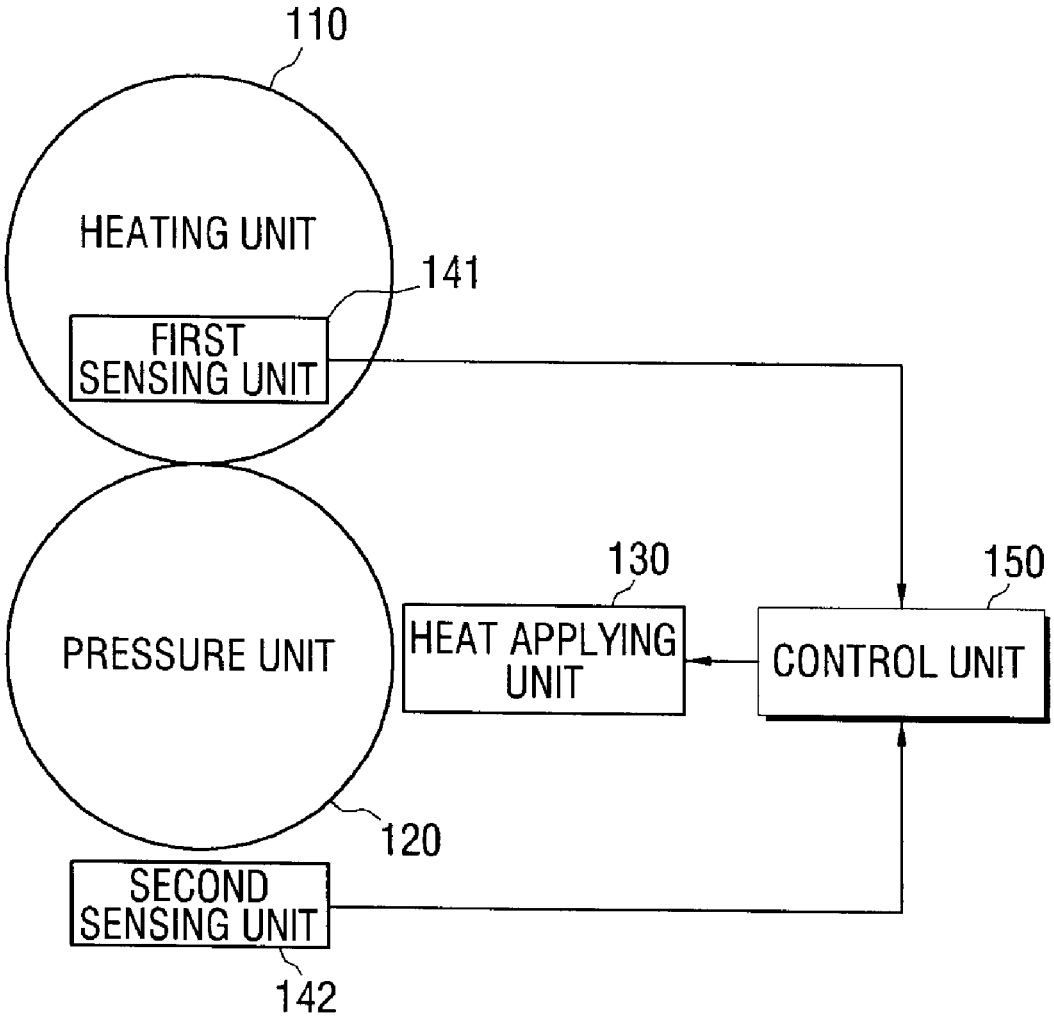
FIG. 2 illustrates an example of the configuration details of relevant portions of an image forming apparatus according to an embodiment of the present disclosure.

FIG. 2 illustrates a configuration of the fusing device in greater detail.

As illustrated in FIG. 2, an image forming apparatus according to an embodiment may further include a fusing device, which in turn may include a first sensing unit 141 and a second sensing unit 142 in addition to the heating unit 110, the pressure unit 120 and the heat applying unit 130, and a control unit 150.

The first sensing unit 141 and the second sensing unit 142 may be provided to sense the temperature of the nip of the heating unit 110 and the temperature of the surface of the pressure unit 120, respectively. The first sensing unit 141 and the second sensing unit 142 may each be implemented as a temperature sensor that exhibits properties that varies according to the temperature, for example, a Schottky diode, a thermistor or the like.

The temperature data sensed by the first sensing unit 141 and the second sensing unit 142 are transmitted to the control unit 150. The control unit 150 calculates the difference between the temperatures sensed by the first sensing unit 141 and the second sensing unit 142, and controls the heat applying unit 130 according to the temperature difference. If the temperature difference is higher than a preset temperature difference, the control unit 150 controls the heat applying unit 130 to increase the temperature of the surface of the pressure unit 120.

The temperatures of the heating unit 110 and the pressure unit 120 can be directly sensed using the first sensing unit 141 and the second sensing unit 142 as in FIG. 2, or alternatively the control unit 150 can determine the temperature difference based on the respective amount of driving electrical power applied to the heating unit 110 and the pressure unit 120.

Figure 3:
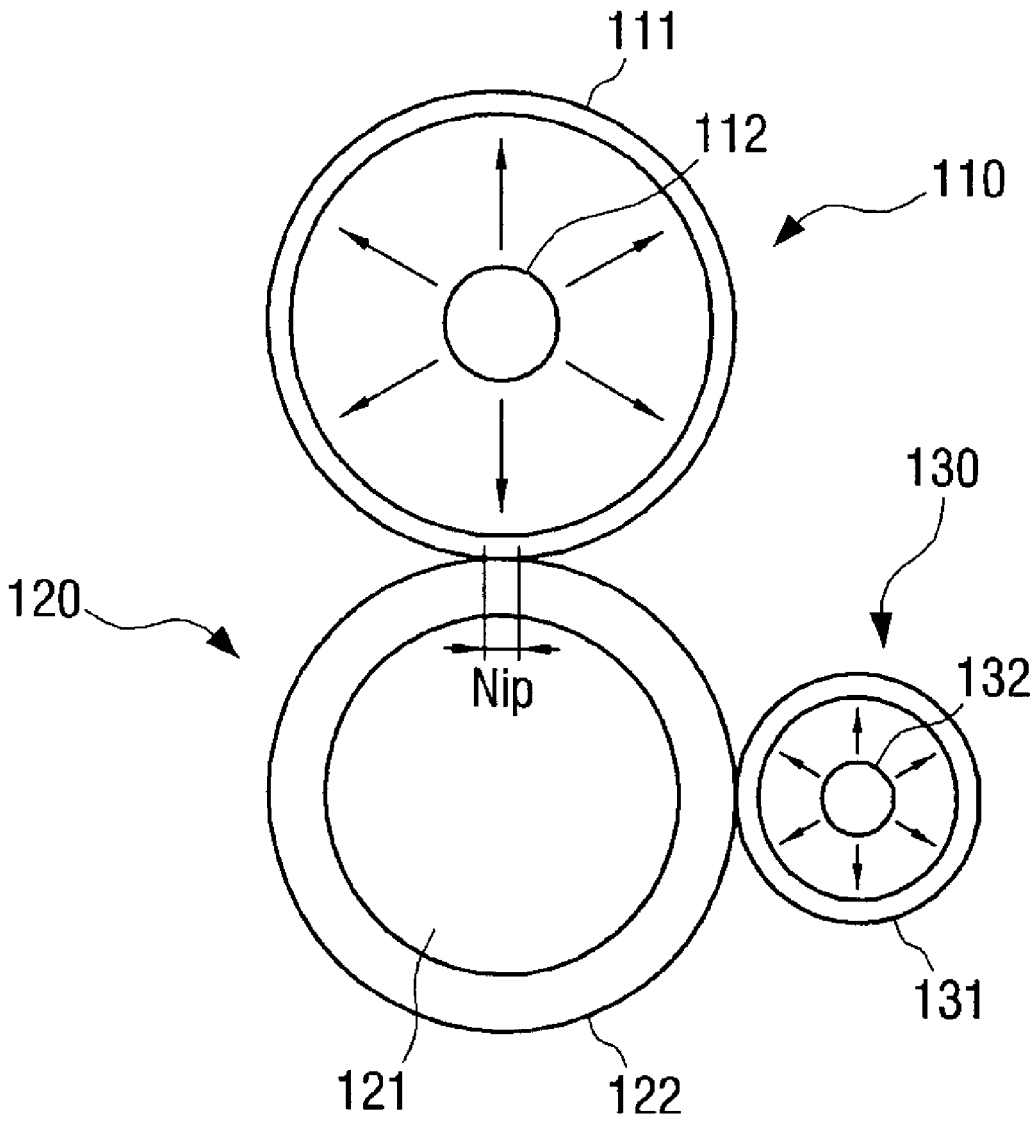
FIGS. 3 to 5 illustrate a fusing device according to several embodiments of the present disclosure.
Figure 4:
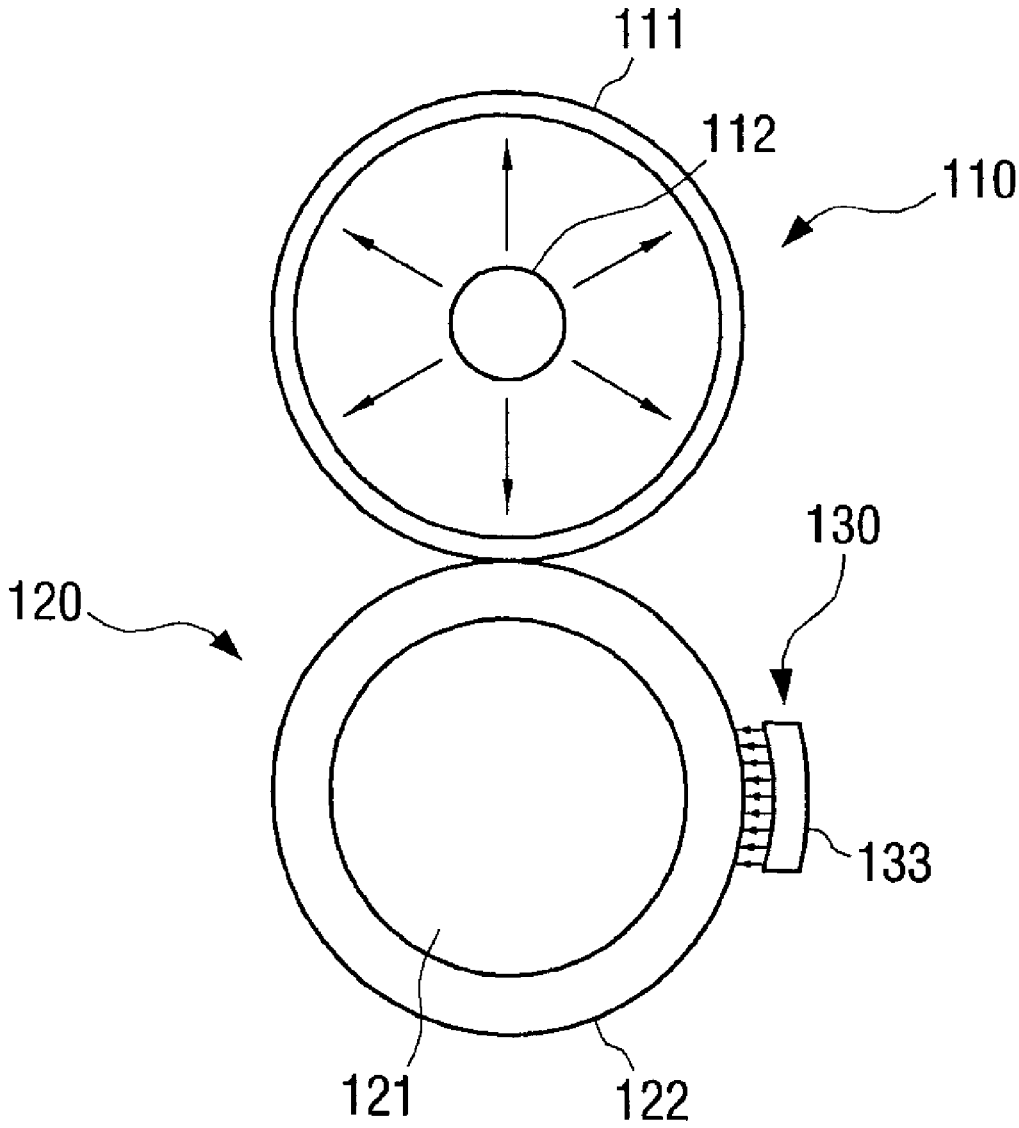
Figure 5:
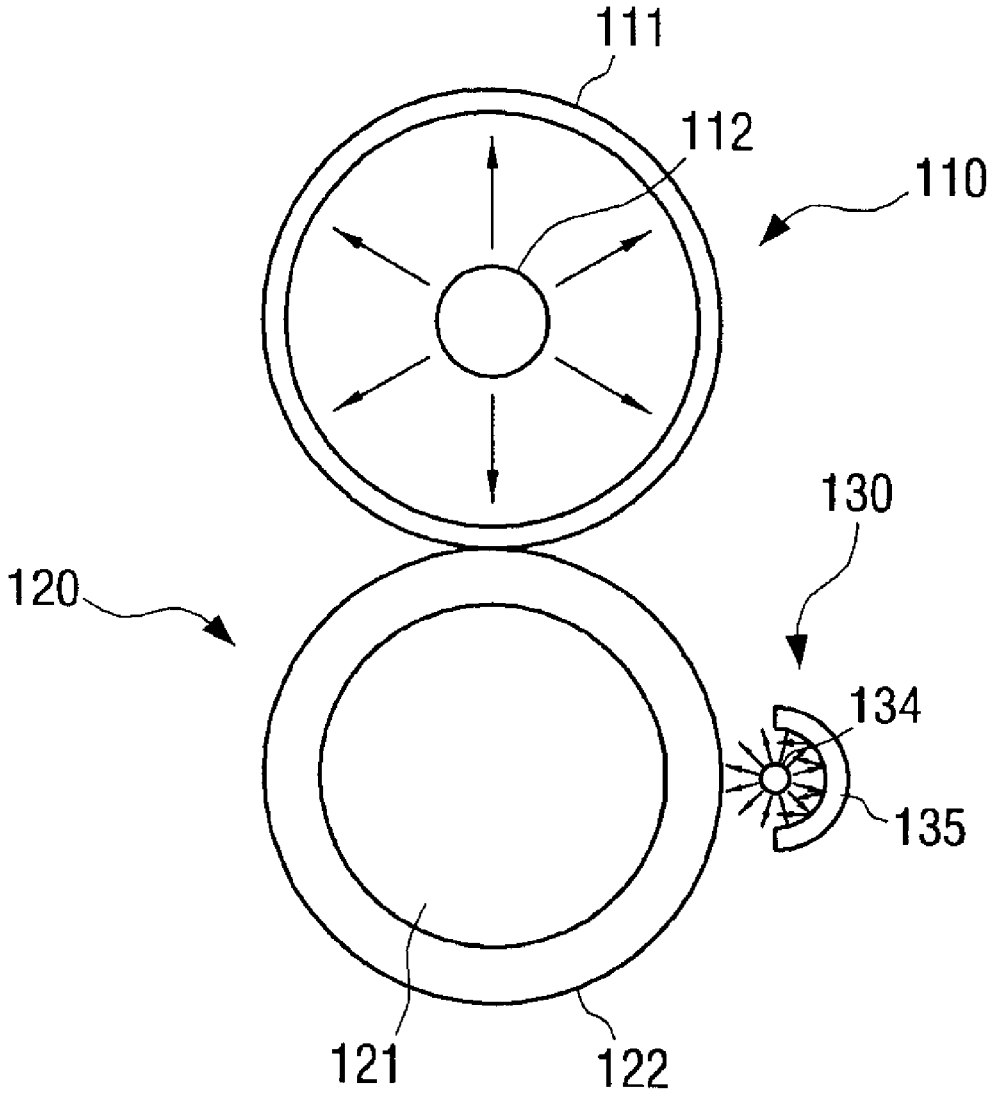

FIGS. 3 to 5 illustrate configurations of a fusing device according to several embodiments of the present invention.

As illustrated in FIG. 3, the heating unit 110 may be formed as a belt. For example, the heating unit 110 may include a belt unit 111 that turns with a portion of its outer surface in contact with the pressure unit 120 and a heat source unit 112 disposed inside the belt unit 111 so as to heat the belt unit 111. One or more rollers (not shown) may be disposed inside the belt unit 111 so as to rotatably support the belt unit 111.

The pressure unit 120 may be implemented as a pressure roller, and may include a shaft 121 and an elastic layer 122.

According to an embodiment, the shaft 121 may be formed of, e.g., metal, and the elastic layer 122 may be formed of an elastic material, such as, for example, foaming rubber. The thickness of the elastic layer 122 may vary according to a specific implementation, but in order to ensure a sufficient area of contact or a nip between the heating unit 110 and the pressure unit 120, a particular thickness of the elastic layer 122 may be selected taking into consideration the softness or stiffness of the material.

The heat applying unit 130 may include a roller 131 and a heat source 132. The roller 131 is in contact with the pressure unit 120, and may be heated by the heat source 132. Accordingly, the heat applying unit 130 can used to heat the surface of the pressure unit 120 to a desired temperature. The roller 131 may be formed of, for example, a metal, such as, for example, aluminum, and may be coated with a material, such as, for example. Teflon®.

The heat source units 112 and 131 may be any device or mechanism that generates heat, and may be, for example, without limitation, a heating lamp, e.g., a halogen lamp, or a resistive wire heater, for example.

FIG. 4 illustrates a heat applying unit 130 implemented as a fixed heat source rather than as a roller. As illustrated in FIG. 4, the heat applying unit 130 may be fixed to a side of the pressure roller so as to apply heat to the pressure roller. The heat applying unit 130 may be implemented as a heating element embedded in or exposed from an insulator. Examples of the insulator material may include MgO, ceramic and a polymer material. As the remaining other components of the fusing device shown in FIG. 4 except for the heat applying unit 130 are substantially similar to those described in connection with FIG. 3, for the sake of brevity, detailed descriptions of these other components are not repeated.

FIG. 5 illustrates another example of a fusing device according to an embodiment of the present disclosure. As illustrated in FIG. 5, the heat applying unit 130 may include a heat source 134 and a reflector 135.

The heat source 134 may be disposed adjacent a side of the pressure roller so as to supply heat to the pressure roller.

The reflector 135 reflects and focuses heat generated by the heat source 134 onto the surface of the pressure roller. The reflector 135 may be formed of, e.g., glass or high molecule resin. Again, for the sake of brevity, detailed descriptions of those other components of the fusing device shown in FIG. 5 that are similar to those described in connection with FIG. 3 are not repeated.

As indicated by the foregoing examples, the heat applying unit 130 may be formed in a variety of shapes so as to heat the surface of the pressure unit 120.

Figure 6:
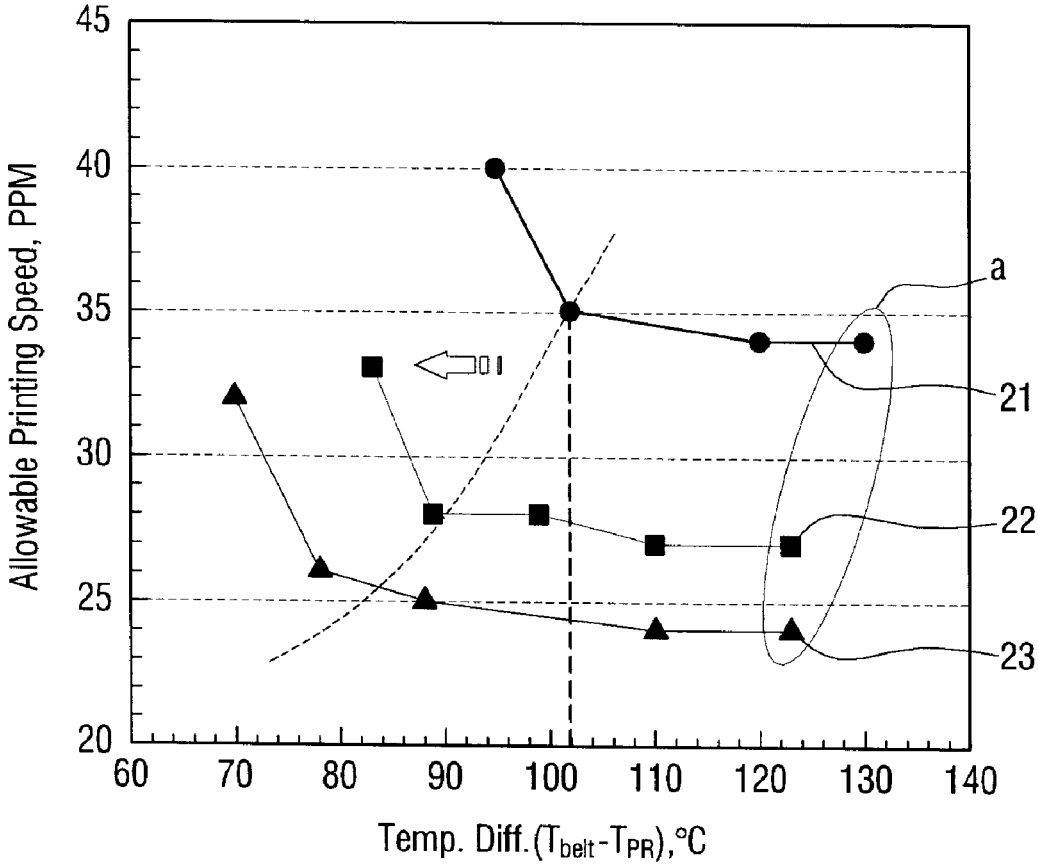
FIG. 6 is a graph illustrating the relationship between the temperature difference between a pressure unit and a heating unit and an allowable printing speed.

FIG. 6 is a graph illustrating a relationship between the temperature difference of the pressure unit 120 and the heating unit 110, and the allowable printing speed of an image forming apparatus according to an embodiment.

Three curves 21, 22, and 23 shown in FIG. 6 may be plotted by empirically measured data points using, for example, a heating unit 110 implemented as a belt and the heat applying unit 130 is formed as a roller similar to those depicted in FIG. 3. The horizontal axis indicates the difference between the temperature ($T_{belt}$) of the heating unit 110 and the temperature ($T_{PR}$) of the pressure unit 120 while the vertical axis indicates the critical printing speed, in page-per-minute (PPM).

By way of an example of specific conditions, the data points for the curves in FIG. 6 are measured when the temperature of the belt unit 111 of the heating unit 110 is 180° C. with the combined power to all the heat sources is 1200 W. The combined power to all the heat sources in this context is the total power that is supplied to both the heating unit 110 and the heat applying unit 130, the heating unit 110 may be provided with 800 W while the heat applying unit 130 may be provided with 400 W, resulting in the combined power of 1200 W.

In prior systems, the power and heat are provided only to the heating unit 110. In contrast, according to an aspect of the present disclosure, heat is also provided to the pressure unit 120 by the heat applying unit 130. The optimum ratio of the respective power provided to the heating unit 110 and the heat applying unit 130 can also be determined empirically.

The roller 131 of the heat applying unit 130, used for the purpose of the experiment, may be formed of a metal, such as, e.g., aluminum, and may be coated with a material, such as, e.g., Teflon®. The roller 131 may have an external diameter of 12 mm and a thickness of 1 mm. The layer of Teflon® coating (not shown) on the roller 131 may have a thickness of 40 μm.

The elastic layer 122 of the pressure roller may be formed of foaming rubber having a thickness of 6 mm, and may have a thermal conductivity of 0.18 W/mK, a density of 1150 $kg/m^3$, a specific heat of 1450 J/kg and a thermal diffusivity of $1.08*10^{-7}$ $m^2/s$. The width of a contact area, i.e., the nip, between the roller 131 and the elastic layer 122 of the pressure roller may be 2 mm.

Under the above conditions, the first to third graphs 21 to 23 are plots of the critical printing speed of when using toners having molecular weights of 58000, 118500 and 140800, respectively.

In FIG. 6, the area "a" indicates that the surface of the pressure unit 120 is not heated. In this case, the temperature difference between the pressure unit 120 and the heating unit 110 is approximately 120° C.-130° C., and at such a temperature difference, the maximum printing speed, that is, the critical printing speed, was observed as 34, 27, and 24 PPM respectively, according to the respective toner molecular weight.

When the temperature difference between the pressure unit 120 and the heating unit 110 is reduced, over a certain range of the temperature differences, a rapid increase in the critical printing speed was not observed. However, when the temperature difference between the pressure unit 120 and the heating unit 110 becomes lower than a certain value, a sharp increase in the critical printing speed is observed as the temperature difference is reduced further. In FIG. 6, the dotted line curve connects the points at which sharp increase in the critical printing speed is seen in each of the curves 21 through 23. As shown in FIG. 6, if the surface of the pressure unit 120 is heated to meet certain conditions, for example, if the conditions correspond to the left of the dotted line curve (indicated by the arrow in FIG. 6), a significant increase in the critical printing speed can be realized.

Figure 7:
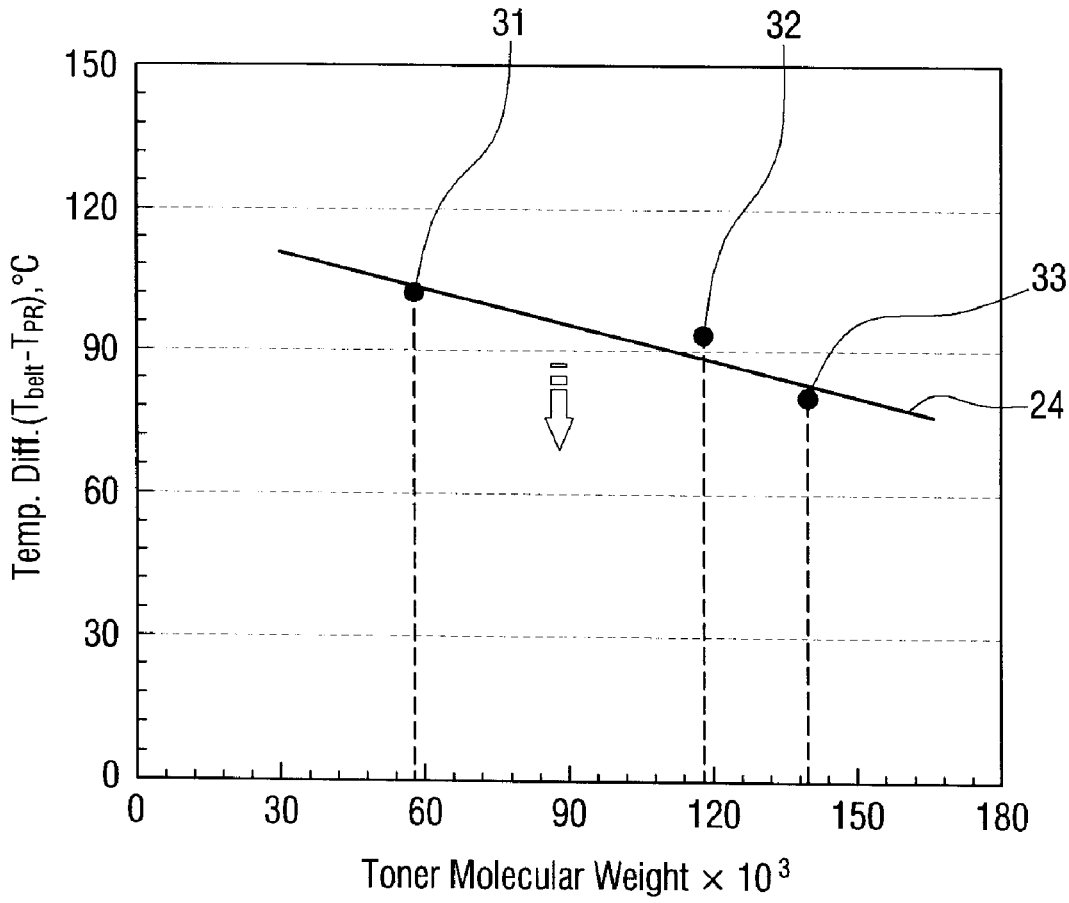
FIG. 7 is a graph illustrating a relationship between the temperature difference between a pressure unit and a heating unit and the molecular weight of the toner.

FIG. 7 is a graph illustrating a relationship between the temperature difference between the pressure unit 120 and the heating unit 110, and the molecular weight of the toner. In FIG. 7, the horizontal axis indicates the molecular weight of the toner (that is, the actual molecular weight of the toner× $10^3$), and the vertical axis indicates the temperature difference.

The line 24 of FIG. 7 is a straight line obtained by connecting the critical points 31, 32, and 33, at which sharp increase in the critical printing speed was observed respectively in each of the curves of FIG. 6 using a straight line approximation. Accordingly, if the temperature condition corresponds to the lower area of the line 24 as indicated by the arrow in FIG. 7, improvements in both the adhesion of the toner and the critical printing speed can be realized.

From the graph 24 of FIG. 7, the following regression equation can be obtained:

$$\Delta T \leqq -0.243 \times M + 117.3 \quad \text{[Equation 1]}$$

In Equation 1, ΔT denotes the temperature difference between the pressure unit 120 and the heating unit 110, more specifically, the temperature difference between the nip of the heating unit 110 and the surface of the pressure unit 120, and M denotes the molecular weight of the toner. M may be "the actual molecular weight of the toner"×$10^3$.

The heat applying unit 130 may adjust ΔT according to a regression equation, for example. Equation 1 shown above, so that the resulting relevant parameters correspond to the area below the line 24 of the graph of FIG. 7. Accordingly, increased the critical printing speed while maintaining the toner affixed to paper may be realized.

While a specific example of the general formula $\Delta T \leqq -a*M+b$, in Equation 1 above, the values for a and b were empirically determined as 0.243 and 117.3, respectively, it should be readily apparent to those skilled in the art from the foregoing description that such coefficients can vary depending on the specific conditions used, and that they can be determined for those other specific conditions empirically.

Although several embodiments of the present disclosure have been shown and described, it would be appreciated by those skilled in the art that changes may be made in these embodiments without departing from the principles and spirit of the inventive aspects of the present disclosure, the scope of which is defined in the claims and their equivalents.

What is claimed is:

1. A fusing device, comprising:

a heating unit configured to provide heat for fixing toner onto paper;

a pressure unit that forms a nip with the heating unit, the pressure unit being configured to supply pressure for fixing toner onto paper; and a heat applying unit arranged adjacent the pressure unit to heat a surface of the pressure unit such that a temperature difference between the surface of the pressure unit and the heating unit satisfies the regression equation $\Delta T \leqq -a \times M+b$, wherein ΔT denotes the temperature difference, a and b denoting empirically determined coefficients, and M denoting the molecular weight of the toner.

2. The fusing device according to claim 1, wherein the pressure unit comprises:

a pressure roller on which an elastic layer is formed.

3. The fusing device according to claim 2, wherein the heat applying unit comprises:

a heat roller which rotates in contact with the pressure roller; and a heat source which is disposed inside the heat roller so as to heat the heat roller.

4. The fusing device according to claim 3, wherein the heat roller is formed of metal, a diameter of the heat roller being approximately between 10% and 50% of that of the pressure roller, the thickness of the heat roller being approximately between 0.6 mm and 1.5 mm, the width of a contact area between the pressure roller and the heat roller being approximately between 2 mm and 10 mm.

5. The fusing device according to claim 2, wherein the heat applying unit comprises:

a heat source arranged adjacent a side of the pressure roller so as to heat the surface of the pressure roller.

6. The fusing device according to claim 2, wherein the heat applying unit comprises:

a heat source disposed adjacent a side of the pressure roller; and a reflector which reflects and focuses heat generated by the heat source onto the surface of the pressure roller.

7. The fusing device according to claim 1, wherein the heating unit comprises:

a belt configured to turns with a portion of an outer surface of the belt unit in contact with the pressure unit; and a heat source disposed inside the belt.

8. The fusing device according to claim 1, wherein values for a and b are 0.243 and 117.3, respectively.

9. An image forming apparatus, comprising:

a charging unit arranged adjacent a photosensitive body and configured to charge a surface of the photosensitive body;

an exposing unit including a light source, the exposing unit being configured to scan light, thereby forming a latent image, on the charged surface of the photosensitive body;

a developing unit arranged adjacent the photosensitive body and configured to provide toner to the surface of the photosensitive body to develop the latent image into a toner image;

a transfer unit having a transfer surface configured to contact paper so as to transfer the toner image onto the paper;

a heating unit arranged to come into contact with the paper bearing the toner image, the heating unit being configured supply heat to the paper so as to fix the toner image onto the paper;

a pressure unit that forms a nip with the heating unit, the pressure unit being configured to supply pressure to the paper so as to fix the toner image onto the paper; and a heat applying unit arranged adjacent, and applying heat to, a surface of the pressure unit such that a temperature difference between the nip and the surface of the pressure unit satisfies the regression equation $\Delta T \leqq -a \times M+b$, wherein ΔT denotes the temperature difference, a and b denoting empirically determined coefficients, and M denoting the molecular weight of the toner.

10. The image forming apparatus according to claim 9, wherein values for a and b are 0.243 and 117.3, respectively.

11. The image forming apparatus according to claim 9, wherein the heating unit comprises a belt.

12. The image forming apparatus according to claim 9, wherein the heating unit comprises a roller.

* * * * *